US007331338B2

(12) United States Patent
Mizek

(10) Patent No.: US 7,331,338 B2
(45) Date of Patent: Feb. 19, 2008

(54) BIASED MOVE-AWAY ARROW REST

(75) Inventor: Robert S. Mizek, Downers Grove, IL (US)

(73) Assignee: New Archery Products Corp., Forest Park, IL (US)

( * ) Notice: Subject to any disclaimer, the term of this patent is extended or adjusted under 35 U.S.C. 154(b) by 85 days.

(21) Appl. No.: 11/290,037

(22) Filed: Nov. 30, 2005

(65) Prior Publication Data

US 2007/0119439 A1 May 31, 2007

(51) Int. Cl.
*F41B 5/22* (2006.01)

(52) U.S. Cl. ..... 124/44.5

(58) Field of Classification Search ..... None
See application file for complete search history.

(56) References Cited

U.S. PATENT DOCUMENTS

| | | | |
|---|---|---|---|
| 4,453,528 | A | 6/1984 | Eckert |
| 4,685,439 | A | 8/1987 | Cosentino, Jr. |
| 4,803,971 | A | 2/1989 | Fletcher |
| 5,365,912 | A | 11/1994 | Pittman |
| 5,390,657 | A | 2/1995 | Larson |
| 5,394,858 | A | 3/1995 | Karolian |
| 5,415,154 | A | 5/1995 | Angeloni |
| 5,490,492 | A | 2/1996 | Savage |
| 5,522,375 | A | 6/1996 | Simo et al. |
| 5,526,799 | A | 6/1996 | Simo |
| 5,632,263 | A | 5/1997 | Sartain |
| 5,722,381 | A | 3/1998 | Mizek |
| 5,743,245 | A | 4/1998 | Mizek |
| 6,044,832 | A | 4/2000 | Piersons, Jr. |
| 6,050,251 | A | 4/2000 | Harwath et al. |
| 6,089,216 | A | 7/2000 | Harwath et al. |
| 6,102,020 | A | 8/2000 | Mizek et al. |
| 6,202,635 | B1 | 3/2001 | Evans |
| 6,615,813 | B1 | 9/2003 | Troncoso, Jr. et al. |
| 6,634,349 | B2 | 10/2003 | Mizek et al. |
| 6,782,881 | B2 | 8/2004 | Mizek et al. |
| 6,823,856 | B2 | 11/2004 | Rager |
| 6,913,008 | B2 | 7/2005 | Simo et al. |
| 6,915,791 | B2 | 7/2005 | Harwath et al. |

OTHER PUBLICATIONS

Co-Pending U.S. Appl. No. 11/031,980, filed on Jan. 6, 2005.

*Primary Examiner*—John A. Ricci
(74) *Attorney, Agent, or Firm*—Pauley Petersen & Erickson

(57) ABSTRACT

An arrow rest rotatably having an arrow support movably mounted with respect to an archery bow. The arrow support can be simultaneously urged in one direction away from an arrow shaft during launch of the arrow shaft, and another portion of the arrow support can be urged in a second direction, toward the arrow shaft. The arrow rest of this invention can be used to accommodate or overcome a spined or bent arrow shaft, such as during initial launch of an arrow from an archery bow.

15 Claims, 6 Drawing Sheets

BIASED MOVE-AWAY ARROW REST

BACKGROUND OF THE INVENTION

1. Field of the Invention

This invention relates to a move-away or drop-away arrow rest that has an arrow support normally biased away from an arrow shaft mounted in a launch or loaded position, with a portion of the arrow support normally biased towards the arrow shaft when in the launch or loaded position.

2. Discussion of Related Art

When shooting or discharging an arrow from an archery bow, some conventional arrow rests move away or drop away from an arrow shaft when the corresponding arrow is shot or discharged from the archery bow. Different conventional arrow rests move away or are forced away from the arrow shaft by gravitational forces or bias forces. U.S. Pat. No. 6,823,856 teaches a move-away arrow rest that drops vertically away from an arrow shaft.

Some conventional arrow rests that use a bias force to move the arrow rest away from the arrow shaft contact the arrow shaft when in the loaded position. Because many conventional arrow rests maintain contact between the arrow rest and the arrow shaft during launch for enough time to stabilize the flight path of a launched arrow, in some cases, the initial discharge forces acting upon the arrow shaft cause the arrow shaft to bend in a longitudinal direction, such as in a spined or arched manner. There is an apparent need for an arrow rest that compensates for those initial discharge forces and the resulting spined, arched or bent condition of the arrow shaft. Compensating for the arrow shaft deformation that occurs during initial discharge forces can improve flight characteristics of the arrow, particularly through the arrow discharge phase and during arrow flight.

SUMMARY OF THE INVENTION

It is one object of this invention to provide an arrow rest that can move away or drop away from an arrow shaft upon discharge of an arrow from an archery bow.

It is another object of this invention to provide an arrow rest that is normally biased toward the arrow shaft and that is also normally biased away from the arrow shaft.

The above and other objects of this invention are accomplished with a move-away, drop-away or fall-away arrow rest that can accommodate a spined or bent arrow shaft upon initial discharge of the arrow from the archery bow.

In certain embodiments of this invention, at least one element or component of an arrow rest is movably mounted with respect to the archery bow. The arrow rest can be rotatably mounted, slidably mounted or movably mounted in any other manner that allows the arrow rest or arrow support to move away from and/or form non-contact with the arrow shaft upon discharge of the arrow.

In some embodiments of this invention, an arrow support is biased or urged in a first direction away from the arrow shaft, before and/or during launch of the arrow shaft, and at least a portion of the arrow support is biased or urged in a second direction toward the arrow shaft. With the bias forces or their force components acting in two different or opposite directions, the portion of the arrow support can move away from the arrow shaft in order to compensate for, reduce or avoid a bent or spined arrow shaft, a condition that often occurs upon the transfer of discharge forces from a bow string to the arrow shaft.

The portion of the support arm that is normally biased toward the loaded arrow shaft can be added to or combined with other conventional move-away, drop-away and/or fall-away arrow rests. A coil spring, leaf spring or any other suitable bias member or element can be used to produce or accomplish the first bias force and/or the second bias force. In certain embodiments according to this invention, the first bias force and the second bias force may have different magnitudes and/or directions, which can be selected as a function of the desired result and/or different factors that can affect the arrow shaft during discharge from an archery bow.

BRIEF DESCRIPTION OF THE DRAWINGS

The above and other features and objects of this invention will be better understood from the following detailed description taken in view of the drawings wherein.

DETAILED DESCRIPTION OF THE INVENTION

Conventional arrow rests can move away from an arrow shaft during discharge of an arrow from an archery bow. U.S. Pat. Nos. 6,634,349 and 6,782,881, the entire teachings of which are incorporated into this specification by reference to each of U.S. Pat. Nos. 6,634,349 and 6,782,881, teach conventional move-away arrow rests.

As used throughout this specification and in the claims, the terms move-away, fall-away and drop-away are intended to relate to and describe an arrow rest that moves away from or forms non-contact with an arrow shaft when discharged from an archery bow, and the terms are intended to be interchangeable with each other and with other similar terms.

Figure 1:
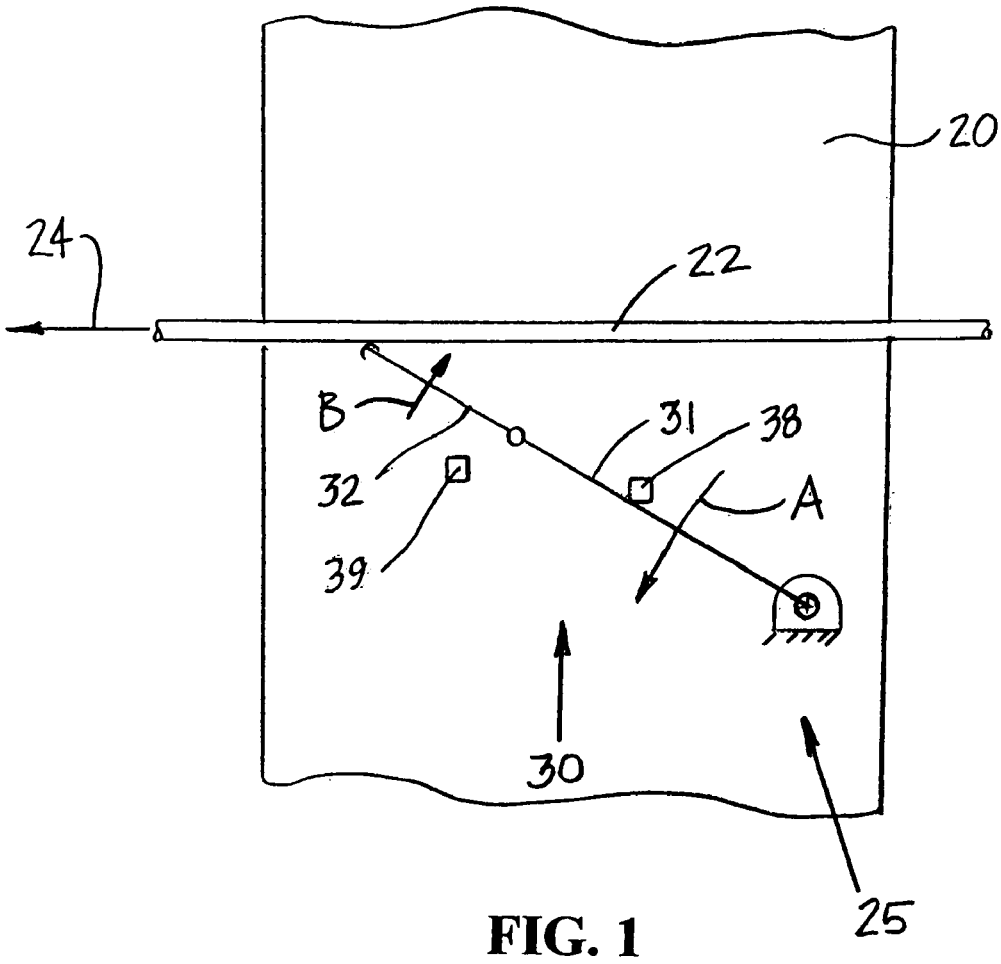
FIG. 1 is a schematic view of an arrow rest movably mounted with respect to an archery bow and supporting an arrow shaft in a loaded position, according to one embodiment of this invention.
Figure 10:
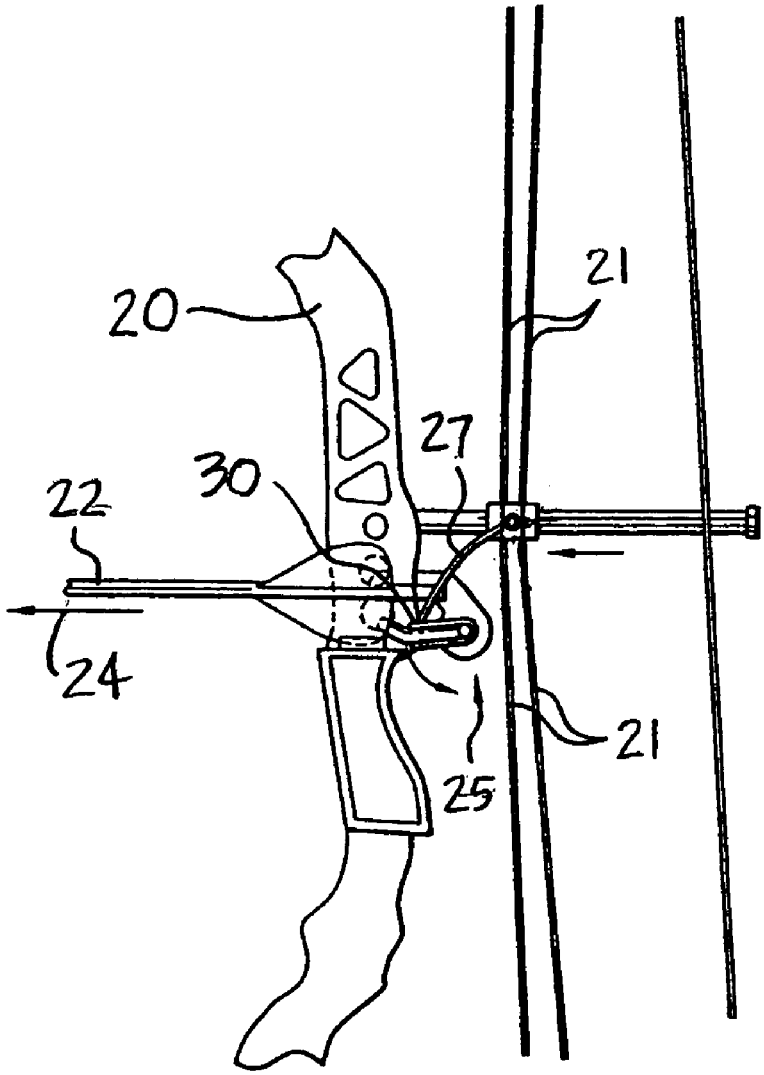
FIG. 10 is a diagrammatic view of an arrow rest in an unloaded position, with the arrow being discharged from the arrow rest and thus the archery bow, according to one embodiment of this invention.

FIG. 1 shows a schematic view of arrow rest 25 with arrow shaft 22 in a launch or loaded position, according to certain embodiments of this invention. As shown in FIG. 1, arrow rest 25 has arrow support 30 that is movably mounted with respect to archery bow 20. As shown in FIG. 1, arrow rest 25 is rotatably or pivotally mounted with respect to archery bow 20. Arrow rest 25 can be moveably mounted to rotate, pivot, slide or move in any other suitable manner, in a linear and/or a non-linear direction, with respect to archery bow 20, in order to move arrow support 30 away from and/or establish non-contact with arrow shaft 22, such as upon discharge of arrow shaft 22 from archery bow 20, particularly in direction 24 as indicated in FIGS. 1 and 10.

U.S. Pat. No. 6,823,856, the entire teachings of which are incorporated into this specification by reference, discloses a vertical drop arrow rest having an arrow support arm that drops in a straight, non-pivotal and non-rotational path. The arrow rest has an arrow support arm that lifts the arrow from a first, relaxed, position to a second, actuated position when an archer draws the bow string. Upon release of the bow string, the arrow support arm drops, with vertical non-rotational and non-pivotal movement, in a straight line, to return to a relaxed state or position. U.S. Pat. No. 6,823,856 is an example of a conventional move-away arrow rest that can be improved with the arrow support of this invention, for example that is normally biased or urged in a first direction away from the arrow shaft during launch of the arrow shaft while at least a portion of the arrow support is urged in a second direction toward the loaded arrow shaft.

FIGS. 1-8 show arrow support 30 comprising portion 31 and portion 32. In certain embodiments of this invention, portion 31 is normally biased or forced away from arrow shaft 22, such as in a direction indicated by arrow A in FIG. 1. FIG. 1 schematically shows portion 32 normally biased or forced in a direction toward loaded arrow shaft 22, the direction of which is indicated by arrow B in FIG. 1.

Figure 2:
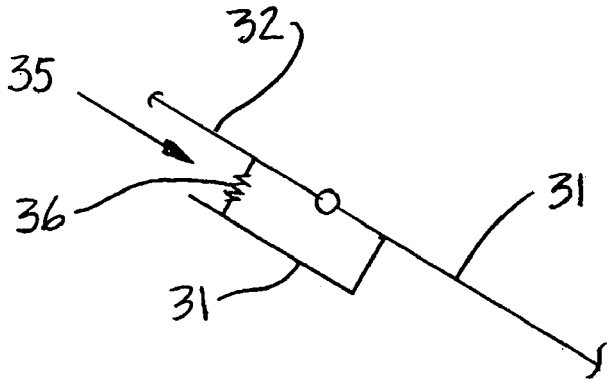
FIG. 2 is a schematic view of an arrow support, according to one embodiment of this invention.

FIGS. 1 and 2 schematically show arrow support 30 comprising portion 32 pivotally linked with respect to portion 31. However, in other embodiments of this invention, arrow support 30 may be one piece, with or without different composite components. Arrow support 30 can comprise any structural arrangement of one or more elements that allow biasing in a first direction, such as shown by arrow A, while portion 32 is biased in a second direction, such as the direction shown by arrow B. In some embodiments of this invention, when arrow support 30 is biased or urged in a first direction away from loaded arrow shaft 22, at least a portion of arrow support 30, such as portion 32 shown in FIG. 1, is biased or urged in a second direction toward arrow shaft 22.

FIG. 2 shows bias element 35 normally biasing, forcing or urging portion 32 toward arrow shaft 22 when arrow shaft 22 is in a loaded position. Bias element 35 may comprise spring 36 and/or any other suitable spring or bias member that normally exerts a force against and/or causes movement of portion 32 of arrow support 30.

Some conventional arrow rests are biased in a direction away from a loaded arrow shaft, such as the direction shown by arrow A in FIG. 1, and the bias force can be accomplished in many different ways which are known to those skilled in the art of move-away arrow rests. The resultant bias force in the direction of arrow A can have one or more force components that oppose the magnitude and/or direction of one or more force components corresponding to a resultant bias force acting in the direction of arrow B as shown in FIG. 1. Depending upon the intended use, the two different resultant bias forces or force components can have the same and/or different magnitudes and/or directions.

Figure 3:
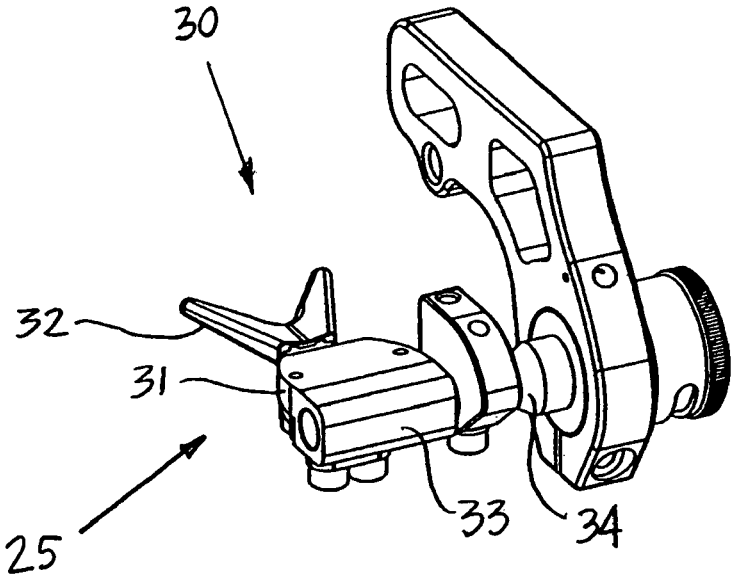
FIG. 3 is a perspective view of an arrow rest in an unloaded position or a discharged position, according to one embodiment of this invention.
Figure 4:
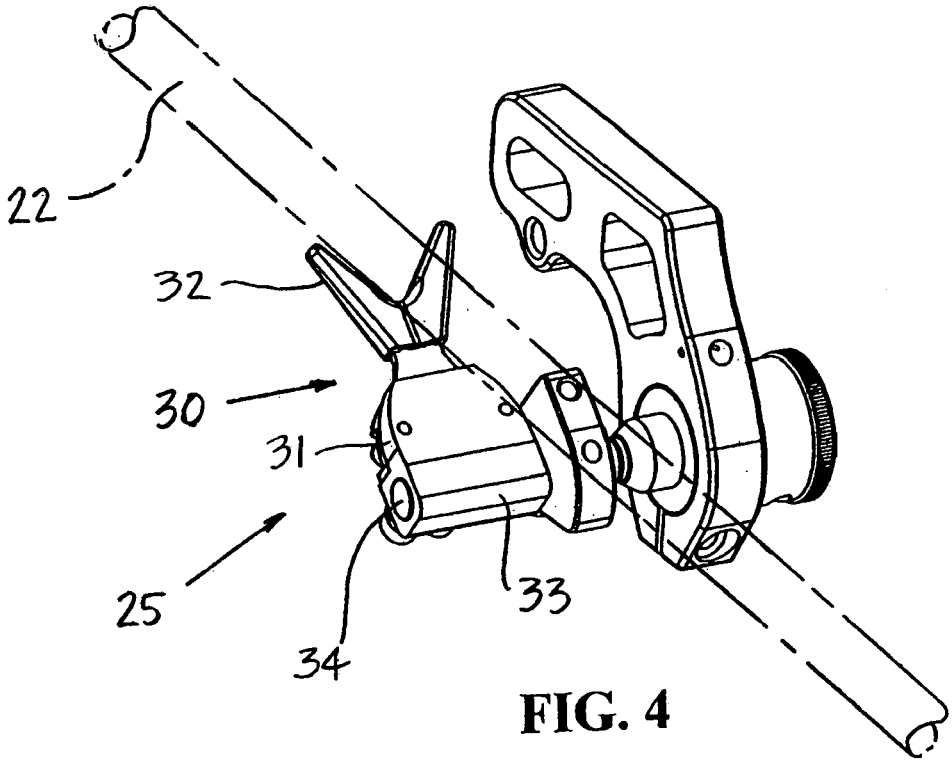
FIG. 4 is a perspective view of the arrow rest shown in FIG. 3, but in a loaded position or a drawn position, showing the loaded arrow shaft in phantom lines.

FIGS. 3 and 4 show arrow support 30 comprising base 33 which is moveably mounted with respect to archery bow 20. As shown in FIGS. 3-8, base 33 is rotatably and slidably mounted with respect to shaft 35. Any other suitable mechanical connection can be used to movably mount base 33, arrow rest 25 and/or arrow support 30 with respect to each other and/or archery bow 20. In some embodiments of this invention, portion 32 of arrow support 30 is movably mounted with respect to base 33.

Figure 8:
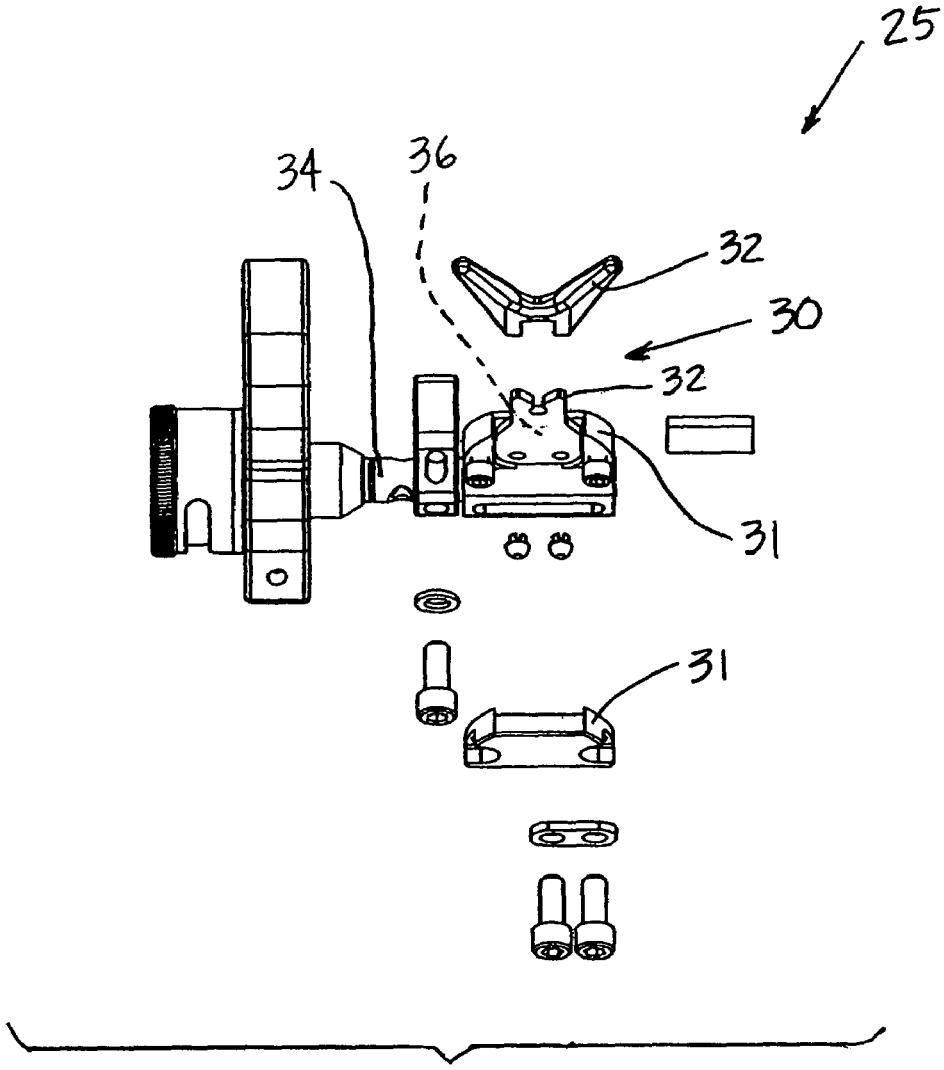
FIG. 8 is an exploded perspective view of an arrow rest, according to one embodiment of this invention.

As shown in FIG. 8, arrow support 30 is detachably mounted to, from or with respect to base 33, such as with a screwed connection or any other suitable mechanical connection that provides a detachable mounting. Arrow support 30 can also be secured to or integrated with base 33 and/or shaft 34.

Figure 5:
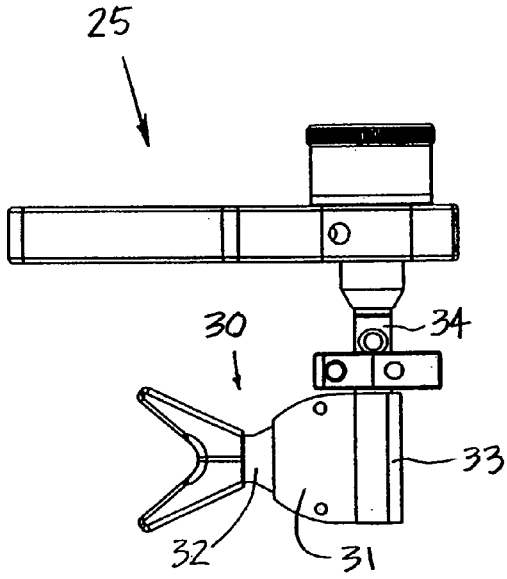
FIG. 5 is a top view of the arrow rest, as shown in FIGS. 3 and 4.
Figure 7:
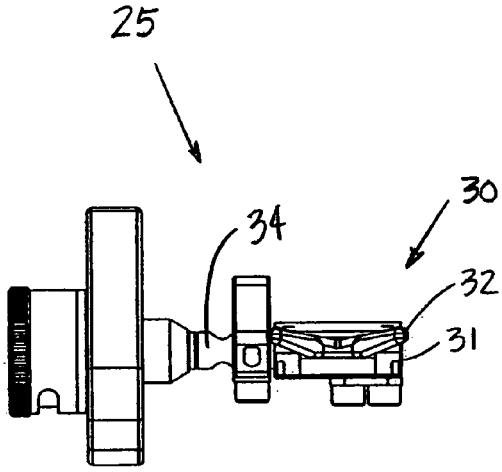
FIG. 7 is a front view of the arrow rest, as shown in FIGS. 3 and 4.
Figure 6:
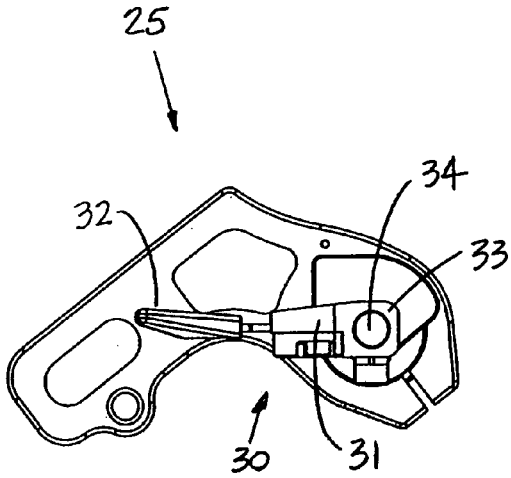
FIG. 6 is a side view of the arrow rest, as shown in FIGS. 3 and 4.

FIGS. 3-5 show arrow support 30 having a fork shaped portion or section that supports arrow shaft 22. Arrow support 30 can have any other suitable shape and/or dimension that provides support for arrow shaft 22.

Figure 9:
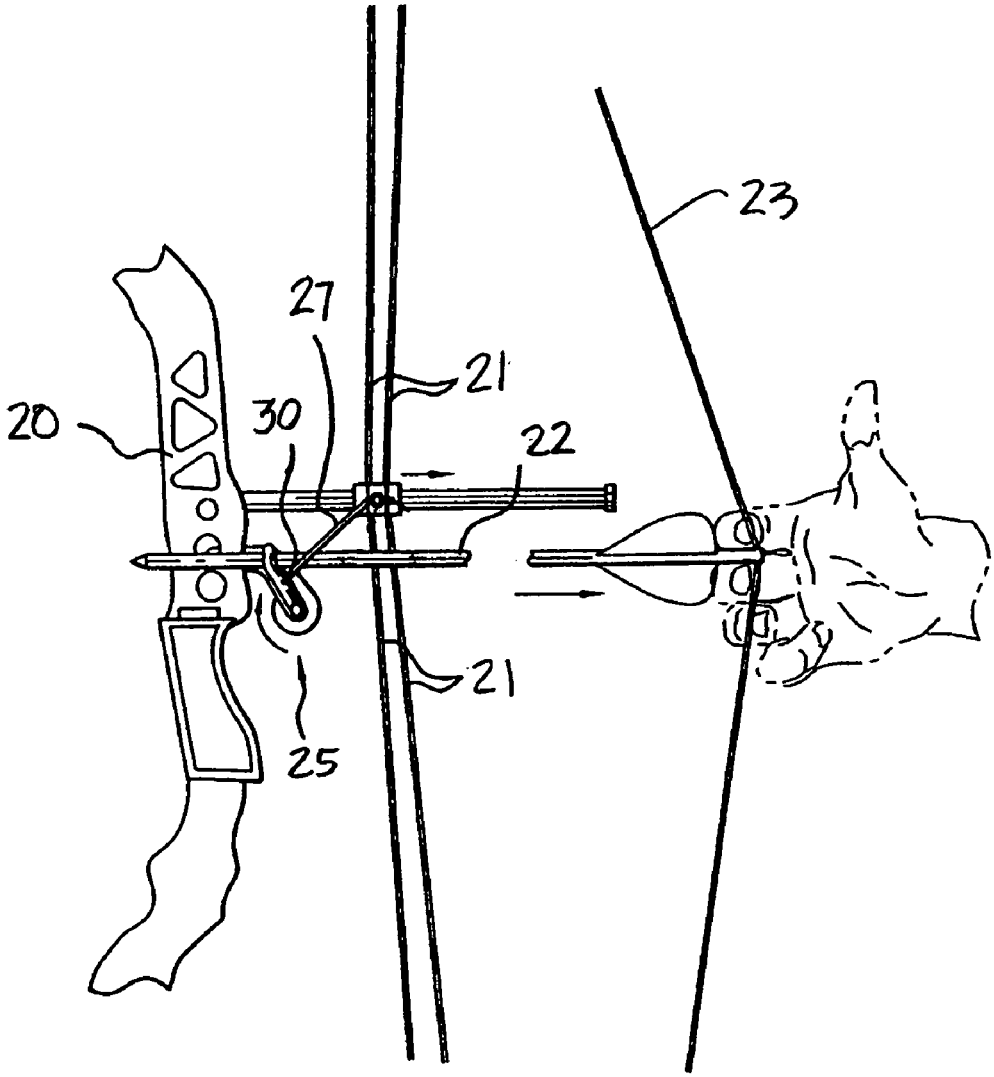
FIG. 9 is a diagrammatic view of an arrow and an arrow rest in a loaded position, according to one embodiment of this invention.

FIG. 9 shows arrow rest 22 comprising link 27, which can be connected, secured and/or attached to or with respect to bus cable 21 of archery bow 20. Link 27 may comprise a cable, a cord, a line, a rod and/or any other flexible and/or rigid element. Link 27 can function in a manner similar to or the same as described in, for example, U.S. Pat. No. 6,782,881. As bow string 23 is drawn back, link 27 can be used to move or draw arrow support 30 in a direction toward arrow shaft 22. A mechanical stop and/or an interference element can be used to limit or stop movement of arrow support 30 in the direction toward and/or in the direction away from loaded arrow shaft 22.

In certain embodiments of this invention, arrow support 30 can be drawn toward arrow shaft 22 with enough force to overcome the normally biased force moving portion 31 away from arrow shaft 22. Portion 31 can be drawn up to any suitable mechanical stop or interference element, such as stop 38 shown in FIG. 1, that limits or stops further movement of portion 31 with respect to arrow shaft 22. Portion 32 can then be movably mounted and normally urged in a direction toward arrow shaft 22. When arrow shaft 22 is discharged from archery bow 20, with arrow rest 25 of this invention, portion 32 of arrow support 30 can be moved in a direction away from arrow shaft 22 by the discharge force overcoming the bias force that normally urges portion 32 toward arrow shaft 22. Stop 39, as shown in FIG. 1, or any other suitable mechanical stop or interference element can be used to limit movement of portion 31, portion 32 and/or arrow support 30 away from arrow shaft 22.

The combination of portion 31 and portion 32 of arrow support 30 can accommodate and/or prevent arrow shaft 22 from splined or bent deformation during initial discharge forces transferred upon release of bow string 23. Arrow rest 25 of this invention can act as a flexible or non-rigid member to accommodate or better steer and/or stabilize the flight path of a launched arrow.

The different elements of this invention can be manufactured from any suitable metal and/or non-metal material, and can also include any unitary or composite structure.

While in the foregoing detailed description this invention has been described in relation to certain preferred embodiments thereof, and many details have been set forth for purposes of illustration, it will be apparent to those skilled in the art that this invention is susceptible to additional embodiments and that certain of the details described herein can be varied considerably without departing from the basic principles of this invention.

What is claimed is:

1. In an arrow rest having an arrow support movably mounted with respect to an archery bow, wherein the arrow support is urged in a first direction away from an arrow shaft during launch of the arrow shaft, the improvement comprising:

at least a portion of the arrow support urged in a second direction toward the arrow shaft and a bias element urging the at least the portion of the arrow support in the second direction.

2. In the arrow rest according to claim 1, wherein the bias element comprises a spring normally biasing the at least a portion of the arrow support in the second direction.

3. In the arrow rest according to claim 1, wherein the arrow support comprises a base movably mounted with respect to the archery bow.

4. In the arrow rest according to claim 3, wherein the base is rotatably mounted with respect to the archery bow.

5. In the arrow rest according to claim 3, wherein the at least the portion of the arrow support is movably mounted with respect to the base.

6. In the arrow rest according to claim 5, wherein the at least the portion of the arrow support is detachably mounted with respect to the base.

7. In the arrow rest according to claim 1, wherein the arrow support is adjustable along a lateral direction with respect to the archery bow.

8. In the arrow rest according to claim 1, wherein the arrow support comprises a fork shaped portion that supports the arrow shaft.

9. In the arrow rest according to claim 1, further comprising a link having a first end attached with respect to the arrow support.

10. In the arrow rest according to claim 9, wherein a second end of the link is attached with respect to a bus cable of the archery bow.

11. In the arrow rest according to claim 9, wherein the link comprises at least one of a cable, a cord, a line and a rod.

12. In the arrow rest according to claim 9, wherein the link is moved to draw the arrow support in the first direction.

13. In an arrow rest having an arrow support movably mounted with respect to an archery bow, wherein the arrow support is urged in a first direction away from an arrow shaft during launch of the arrow shaft, the improvement comprising:

at least a portion of the arrow support urged in a second direction toward the arrow shaft, the arrow support comprising a base movably mounted with respect to the archery bow, at least the portion of the arrow support movably mounted with respect to the base and a spring urging the at least the portion of the arrow support in the second direction.

14. An arrow rest attachable to an archery bow for supporting an arrow shaft, the arrow rest comprising:

a base movably mounted with respect to the archery bow, the base urged in a first direction away from the arrow shaft, an arrow support urged in a second direction toward the arrow shaft, and a spring applying a bias force to the arrow support in the second direction.

15. A method for launching an arrow from an archery bow, including:

normally urging an arrow support in a first direction away from an arrow shaft of the arrow;

drawing the arrow support in a second direction toward the arrow shaft; and normally urging at least a portion of the arrow support in a second direction away from the arrow shaft, wherein a spring normally urges the at least the portion of the arrow support in the second direction.

* * * * *